United States Patent [19]

Olsen

[11] 4,067,413

[45] Jan. 10, 1978

[54] COLLAPSIBLE LADDERS

[76] Inventor: Herbert Olsen, Konitsis Kallithea, Athens, Greece

[21] Appl. No.: 601,532

[22] Filed: Aug. 4, 1975

[51] Int. Cl.[2] ..... E06C 1/383; E06C 7/08; E06C 7/50

[52] U.S. Cl. ..... 182/164; 182/70; 403/96; 403/102

[58] Field of Search ..... 182/163, 164, 196, 197, 182/198, 70; 403/92, 93, 97, 101, 102, 146, 96

[56] References Cited

U.S. PATENT DOCUMENTS

| | | | |
|---|---|---|---|
| 33,963 | 12/1861 | Shannon | 182/164 |
| 308,179 | 11/1884 | Linnenbrink | 182/164 |
| 628,824 | 7/1899 | Maier | 182/164 |
| 765,598 | 7/1904 | Schlag | 403/146 |
| 955,314 | 4/1910 | Borne | 403/96 |
| 992,785 | 5/1911 | Lloyd | 182/163 |
| 1,102,461 | 7/1914 | Vaughan | 182/163 |
| 1,696,357 | 12/1928 | Johnson | 182/163 |
| 2,301,077 | 11/1942 | Payton | 403/146 |
| 3,474,881 | 10/1969 | Green | 182/163 |
| 3,677,366 | 7/1972 | Loeffel | 182/70 |

*Primary Examiner*—Reinaldo P. Machado
*Attorney, Agent, or Firm*—Edward B. Gregg

[57] ABSTRACT

A collapsible ladder for use as an emergency escapeway is described which has two side members between which rungs extend. The side members are each composed of a plurality of sections, which are pivoted to each other at overlapping ends. In one embodiment, the rungs extend between alternate pairs of the sections, while the intermediate sections are provided with fender spars which fold parallel with the section, and swing into position to space the ladder away from a wall, when the ladder is unfolded. The sections are held in place relative each other on unfolding of the ladder by a pin on one section received in an arcuate slot partially surrounding the pivot of the next section. In a modified embodiment each section has at each end adjacent the pivot a stud and a recess, which engage complimentary recesses and studs on the adjacent sections.

5 Claims, 10 Drawing Figures

COLLAPSIBLE LADDERS

This invention relates to collapsible ladders and especially to an emergency escape ladder.

The object of the invention is to provide a ladder which is capable of being collapsed into a small storage space.

According to the invention a collapsible ladder comprising rungs connected to the side members, each side member made up of pivotally connected sections for collapsing the ladder from a straight or substantially straight erected condition into a collapsed inoperative position. Each section having an aperture at each end to receive a pivot and a projection from one face and one end of such section, and at the other end an arcuate recess about the respective aperture the recess terminating in an abutment providing co-operative stops near to the common pivot of adjacent sections and adapted to engage one another in the erected condition for preventing further relative rotation of adjacent sections.

The rungs may each comprise a tread portion extending transversely between the side members with end portions perpendicular to the tread portion, each end portion being apertured for receiving securing means such as bolts or rivets for attachment to the side member. Each rung may be of integral construction, for example a casting of aluminium alloy, and may be of open box shape with side walls connected to the tread and end portions.

The side member sections between rungs may be sufficiently short for more than one section to extend between adjacent rungs, to facilitate the collapsing of the ladder into the inoperative position. The number of sections between rungs and the position of the rungs on the hinged sections should preferably be such that the ladder may be evenly stacked when in the inoperative position for example rungs may be attached to alternate pivotally connected sections of the side members. If overlapping joints are used between sections the sections with rungs attached should preferably be on the inside to allow the other sections to clear the rungs when collapsed.

Each section of the side members may be formed for example as a casting from aluminium alloy, with an aperture at each end to receive a pivot and a projection from the face at one end and, at the other end, an arcuate recess above the aperture in the same face, terminating in an abutment. The sections are assembled with the projection at one end of the section received in the recess at the end of an adjacent section; a nut and bolt or rivet may be used to form a rivet between sections. Farther apertures may be provided in the sections for receiving belts for securing them to the ends of rungs, the farther apertures being countersunk on the face with the projection and recess.

Securing seams for suspending the ladder may be provided at one end, for example one end of the ladder may be secured in a case for accommodating the collapsed ladder; the case itself being provided with securing means for its attachment to a wall or balcony for use to support people descending to ground level.

On each side member fender bars may be located which, operating by gravity, fall into position perpendicular to the side member, thus keeping the erected ladder at a distance from the wall.

The collapsible ladder is more stable, in its extended, erected state with the steps of adjacent side member sections and fender bars in their operative position, than a rope ladder in the plane normal to the plane of the ladder and does not sway unduly in a lateral direction due to the securing of the sections against each other by the pivots between them.

A specific embodiment will now be described by way of example with reference to the accompanying drawings in which:

FIG. 1 shows the ladder extended,

FIG. 2 in a side elevation of a rung of the ladder,

FIG. 3 is a side elevation of one section of the side members, showing the fender bar in operative position, FIG. 4 shows two further side elevations of one section of the side members showing the projection and arcuate recess, FIG. 5 is a side view of a ladder accommodating and securing means mounted on a balcony, showing the ladder in extended form, FIG. 6 is a partial side view of the ladder in stored form.

Figure 1:
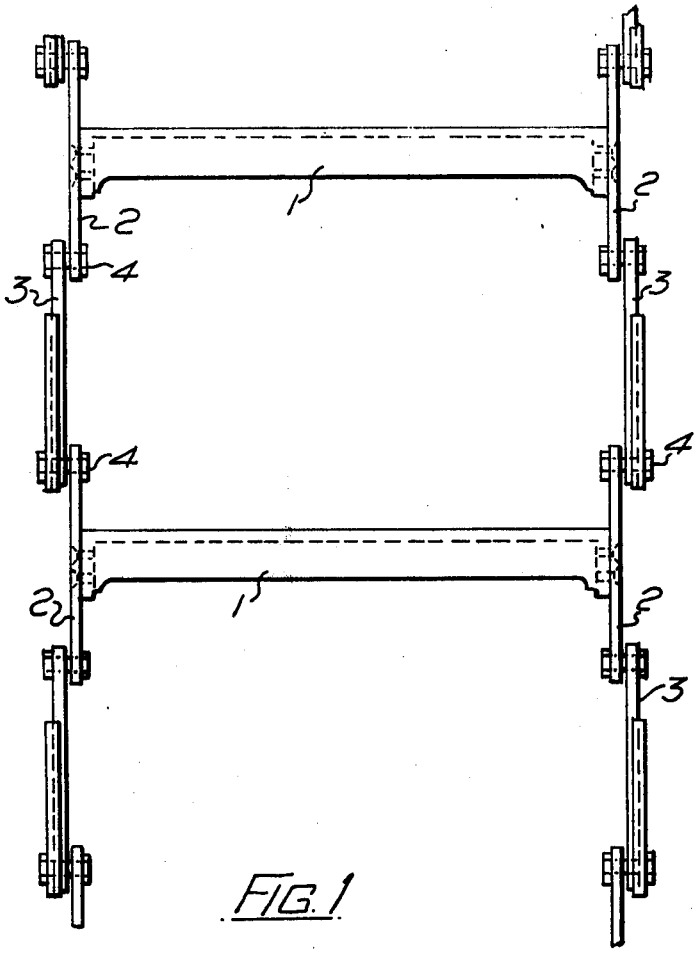

Referring to FIGS. 1 to 6 rungs 1 of cast aluminium alloy are secured by countersunk screws to the inside sections 2 of the side members of the ladder. The sections 2 are pivotally connected to outside sections 3 by nuts and bolts 4. Each section of the side members is formed from a basic unit, illustrated in FIG. 4 which is cast in an aluminium alloy and has a hole 5 at each end with a projection 6 near one end hole and an arcuate recess 7 near the other.

When assembled the projection slides in the arcuate recess and limits the angle of rotation of adjacent sections.

Spars 8 pivot on alternate joints between side member sections and have end stops 9, 10 to limit rotational movement of the fender bars to 90° between the collapsed position parallel to the sections and the operative position normal to the sections.

Figure 6:
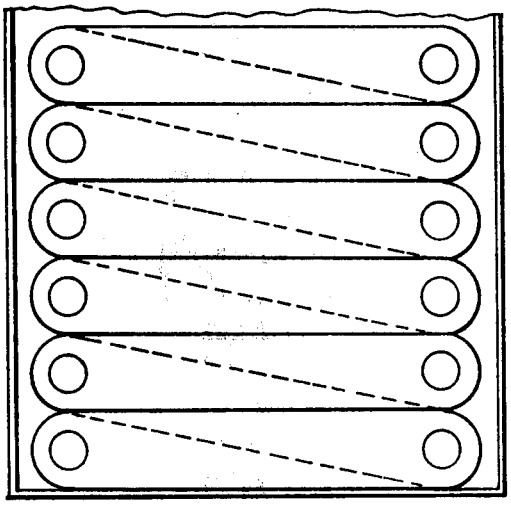

In use the ladder is stacked as in FIG. 6. The end of the ladder may be anchored to a wall or balcony with a framework or carrier 11 around to hold the stacked sections when inoperative.

Figure 7:
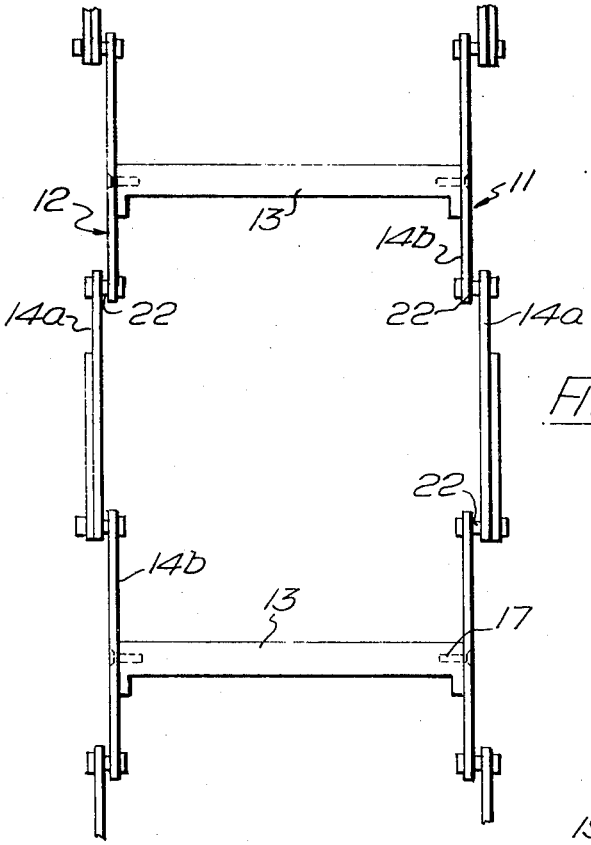
FIG. 7 is a view of part of a further collapsible ladder when extended.
Figure 8:
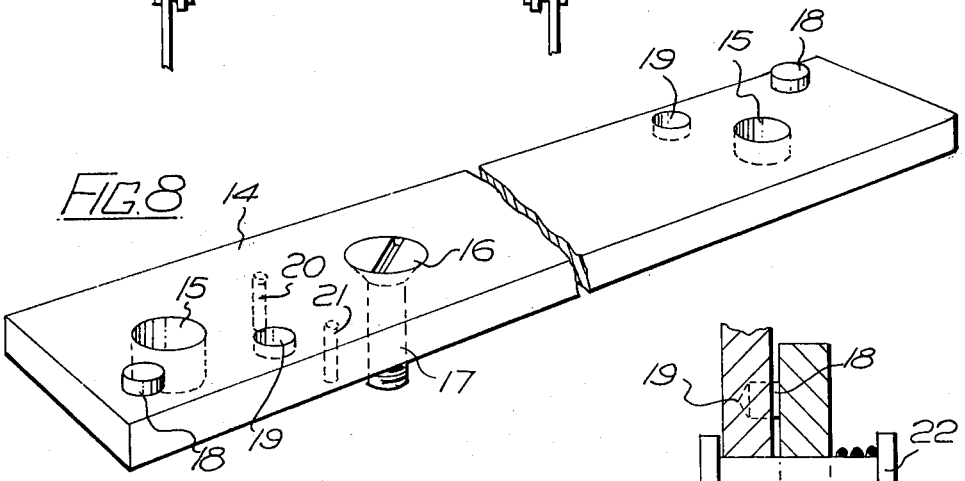
FIG. 8 is a perspective view of a modified side member section.
Figure 9:
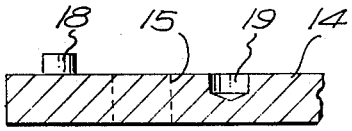
FIG. 9 is a sectional view of one end of the section.

Referring now to FIGS. 7 to 9, FIG. 7 shows a part of a further collapsible ladder 10 having two side members 11, 12 between which extend rungs 13. The side members are composed of pivoted sections 14 which each comprise a rectangular metal bar, having holes 15 near each end. A further countersunk aperture 16 is provided in alternate sections between these holes 15 to receive a rung supporting bolt 17. One face of the bar cames projecting pins 18 and has recesses 19 formed therein. The other face has pins 20 received in pin holes 21.

Figure 10:
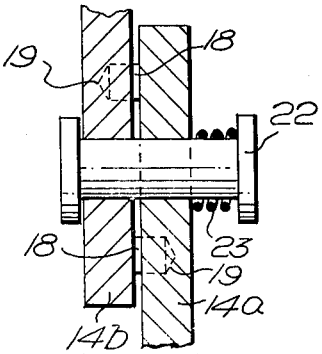
FIG. 10 is a sectional view showing the manner in which the side members are joined together.

The recesses 19 and pins 18 may be disposed in symmetrical arrangements at each end of the section. The arrangements being mirror images in inner ones 14*a* of the sections to the arrangements on the outer ones 14*b* of the sections, so that when the sections 14*a*, 14*b* are placed face to face where their ends overlap to receive a pivot pin 22, the pins 18 of one section can enter the recesses 19 of the other section, and vice-versa. FIG. 10 shows the ends of two sections, 14*a*, 14*b* mounted on a pivot pin 22, with the pins 18 in the recesses 19. The sections 14*a*, 14*b* are biased into contact by a spring 23 surrounding the pivot pin, and seated on one section and on a head of the pivot pin.

Figure 2:
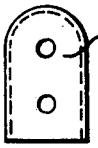
Figure 3:
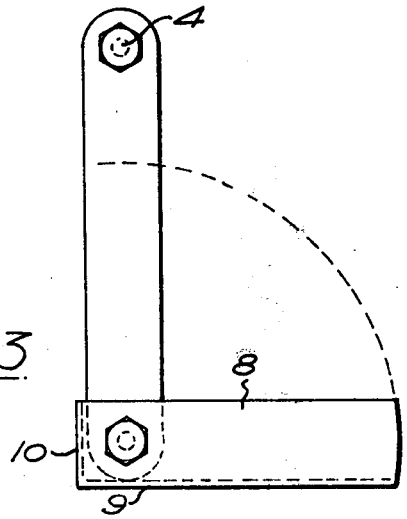
Figure 4:
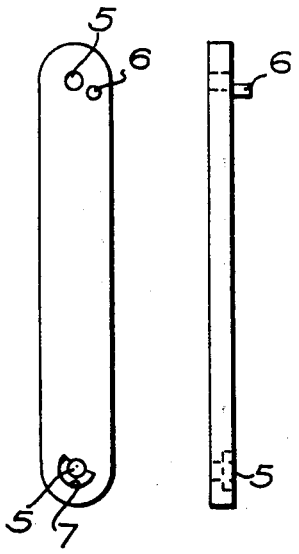
Figure 5:
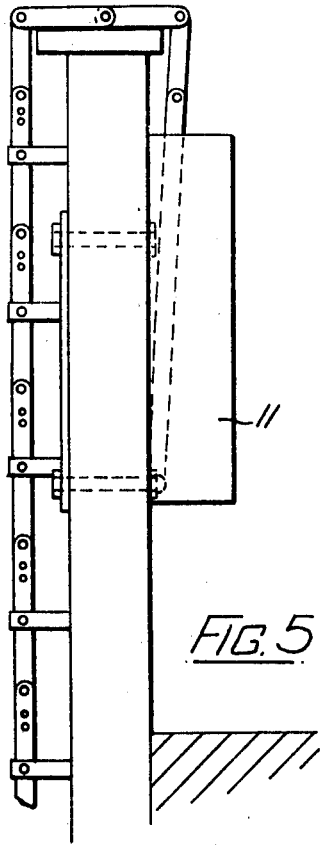

In use, adjacent sections such as that illustrated in FIG. 2 are pivoted together on the pivot pins 22 which pass through holes 15 to form a side member of a ladder as shown in FIG. 1.

The faces of the bars provided with pins 18 and recesses 19 are presented facing each other, and when the sections 14 are pivoted into a mutually suitable position, the pins 18 in each section 14 enter the sockets 19 in the opposed face of the other section, and the sections are locked into the desired position.

The pins 20 serve to retain and maintain the orientation of a rung 13 relative to the section 14.

The sections shown in the drawings are constrained by the disposition of the pins 18 and recesses 19 to form a straight-line side member. However, it may be required to have the sections at an angle to each other and rigidly held in place, and this may be achieved by variation of the location of pins 18 and recesses 19.

I claim:

1. A side member for a collapsible ladder, comprised of a plurality of sections having an aperture at each end for pivoting to a further similar section, wherein adjacent ones of said sections are mounted on a pivot pin extending through their respective apertures, and their faces upon which the respective projections and recesses are provided are disposed so as to face one another, so that the projections on each face will engage on the recesses in the other face and wherein the said faces of the sections are biased into abutment by a spring mounted on each pivot pin.

2. A side member according to claim 1 wherein the said spring is seated at one end of the face of one of the sections opposite the said abutting face of the section, and is seated at its other end on a head provided on the pivot pin.

3. A collapsible ladder comprising:

a. a plurality of rungs, each extending between two side members, each side member being composed of a plurality of sections, each articulated to an adjacent section on at least one end region thereof, b. the rungs extending between and being secured at each end to intermediate regions of alternate pairs of said sections, c. gravity operable fender struts pivotally mounted on each side member at alternate points of articulation between adjacent side member sections, d. a stud or projection formed on one face of each section adjacent at least one of the points of articulation, e. a recess for reception of such a stud or projection formed on said face of each section adjacent at least the other of said points of articulation, the said faces of adjacent sections being disposed in face-to-face relationship in said end regions, f. articulation between said sections at each said point of articulation being by way of a pivot pin passed through apertures in said sections, said pivot pin providing a seat for a spring which is also seated against the face of one of the sections opposite its said one face to bias the sections into contact, whereby said projections are pushed into said recesses when they become aligned, in response to said spring, to hold the latter substantially rigid.

4. A collapsible ladder according to claim 3, wherein, on each section, said projection is a cylindrical stud provided adjacent the aperture for said pivot pins, said stud being located on a line drawn at an acute angle to the center line of the side member, and said recess is an arcuate recess extending about 180° around the other aperture, in the other side member of said side member.

5. A collapsible ladder according to claim 3, wherein in each section one said projection and one said recess are located adjacent each of said apertures, recess and projection being located between the aperture and one side edge of the section and forming an isoscelles triangle with the aperture, the aperture recesses and projections being disposed so that the projections and recesses at the respective ends are adjacent opposite side edges.

* * * * *